US012604939B1

(12) United States Patent
Sailor

(10) Patent No.: US 12,604,939 B1
(45) Date of Patent: Apr. 21, 2026

(54) HAT WITH AN OPENING FOR HAIR

(71) Applicant: JnT Holdings LLC, Tampa, FL (US)

(72) Inventor: Jeremiah Tyrone Sailor, Tampa, FL (US)

(73) Assignee: JnT Holdings LLC, Tampa, FL (US)

( * ) Notice: Subject to any disclaimer, the term of this patent is extended or adjusted under 35 U.S.C. 154(b) by 0 days.

(21) Appl. No.: 18/892,789

(22) Filed: Sep. 23, 2024

Related U.S. Application Data

(60) Provisional application No. 63/587,578, filed on Oct. 3, 2023.

(51) Int. Cl.
*A42B 1/22* (2006.01)
*A44B 19/00* (2006.01)

(52) U.S. Cl.
CPC ..... *A42B 1/225* (2013.01); *A44B 19/00* (2013.01)

(58) Field of Classification Search
CPC ..... A42B 1/22; A42B 1/225
See application file for complete search history.

(56) References Cited

U.S. PATENT DOCUMENTS 5,321,854 A * 6/1994 Kronenberger ..... A42B 1/225 2/209.3
5,509,145 A * 4/1996 Stevenson ..... A42B 1/225 2/171.4
5,511,249 A * 4/1996 Higgins ..... A42B 1/225 2/209.7
5,799,334 A * 9/1998 Griffith ..... A42B 1/225 2/195.1
5,933,872 A * 8/1999 Lema ..... A42B 1/225 2/209.3
6,421,838 B1 * 7/2002 Frank ..... A42B 1/225 2/195.3
7,178,172 B2 2/2007 Laing
D564,183 S * 3/2008 Roach ..... D2/865
7,945,971 B2 * 5/2011 Garza ..... A42B 1/225 2/171.4
8,418,266 B1 * 4/2013 Pike ..... A42B 1/004 2/209.13
9,210,960 B1 * 12/2015 Linn ..... A42B 1/225
9,375,042 B1 * 6/2016 Koziol ..... A42B 1/004
10,021,929 B1 * 7/2018 Kirschner ..... A42B 1/242
11,219,261 B1 * 1/2022 Thomas ..... A42B 1/225
2003/0172439 A1 * 9/2003 Claro ..... A42B 1/22 2/195.2

(Continued)

FOREIGN PATENT DOCUMENTS

WO WO-2024227218 A1 * 11/2024

*Primary Examiner* — Heather Mangine

(57) ABSTRACT

A hat configured to be worn by a user is described. The hat comprises a main portion that includes an opening at a top side of the main portion. The opening is adapted to be in an exposed state and a covered state. In the exposed state, the opening facilitates the user to extend at least some portion of hair out of the hat. The main portion further includes a support element configured to be in an extended state and a folded state. The main portion further includes a first Velcro strip and a second Velcro strip configured to be in engagement with each other. When the first Velcro strip is engaged with the second Velcro strip, the opening is in the covered state thereof, and when the first Velcro strip is dis-engaged with the second Velcro strip, the opening is in the exposed state thereof.

19 Claims, 7 Drawing Sheets

(56) References Cited

U.S. PATENT DOCUMENTS

2004/0006809 A1* 1/2004 Crenshaw ..... A42C 5/04 2/209.3
2005/0066421 A1* 3/2005 Brundage ..... A42C 5/00 2/209.3
2005/0108810 A1* 5/2005 Yan ..... A42B 1/225 2/195.4
2006/0010566 A1* 1/2006 Ridgeway ..... A42B 1/225 2/171
2006/0117461 A1* 6/2006 Kelly ..... A42B 1/225 2/209.13
2006/0137074 A1* 6/2006 Laing ..... A42B 1/225 2/195.2
2006/0179544 A1* 8/2006 Knievel ..... A42B 1/041 2/181
2006/0206984 A1* 9/2006 Jaye ..... A42B 1/225 2/209.3
2007/0250987 A1* 11/2007 Adkins ..... A42B 1/225 2/209.3
2008/0092272 A1* 4/2008 Vainio ..... A42B 1/225 2/209.3
2008/0201825 A1* 8/2008 Chun ..... A42B 1/225 2/209.13
2009/0083898 A1* 4/2009 Shirey ..... A42B 1/225 2/209.3
2009/0199323 A1* 8/2009 Zakarian ..... A45D 8/40 132/273
2009/0255030 A1* 10/2009 Guy ..... A42B 1/225 2/195.3
2010/0186147 A1* 7/2010 Garza ..... A42B 1/205 2/244
2011/0173739 A1* 7/2011 Riesen ..... A42B 1/225 2/209.3
2014/0082826 A1* 3/2014 Kuthari ..... A42B 1/225 2/171.7
2014/0130235 A1* 5/2014 Johnson ..... A42B 1/225 2/209.3
2014/0338092 A1* 11/2014 Kinsey ..... A42B 1/048 2/84
2015/0135392 A1* 5/2015 Bono ..... A63B 33/00 2/68
2015/0342280 A1* 12/2015 James ..... A42B 1/225 2/172
2016/0309872 A1* 10/2016 Domizi ..... A42B 1/225
2016/0331056 A1* 11/2016 Son ..... A42B 1/049
2017/0258166 A1* 9/2017 Charles, Jr. ..... A42B 1/225
2018/0255859 A1* 9/2018 Gerstle ..... A42C 5/02
2018/0255860 A1* 9/2018 Heaton ..... A42B 1/245
2018/0325201 A1 11/2018 Johnson
2019/0037951 A1* 2/2019 Rue ..... A42B 1/225
2019/0365006 A1* 12/2019 Lim ..... A42B 1/225
2020/0196695 A1* 6/2020 Ault ..... A42B 1/225
2020/0305531 A1* 10/2020 Harry ..... A42B 1/225
2022/0061442 A1* 3/2022 Rymer ..... A42B 1/22
2022/0192305 A1* 6/2022 Kee ..... A42B 1/225
2024/0358108 A1* 10/2024 Hartfield ..... A42B 1/205

* cited by examiner

HAT WITH AN OPENING FOR HAIR

CROSS-REFERENCE TO RELATED APPLICATIONS

This application claims the benefit of U.S. Provisional Patent Application Ser. No. 63/587,578 filed on Oct. 3, 2023, which is incorporated by reference herein in its entirety.

FIELD OF THE INVENTION

The present invention relates generally to hats, and more particularly to a hat having an opening for a user to extend the hair out of the hat.

BACKGROUND OF THE INVENTION

Generally, hats and caps are worn by people for various reasons. For instance, some people may wear hats for covering their head as an accessory, to protect against weather conditions, and the like. As another example, some people may wear hats to protect against sun rays and UV radiation, while some people may wear hats to add a fashion element to their look.

Conventional hats may be of various types, such as bucket caps, flat caps, baseball caps, fedora caps, and the like. Conventional hats generally have a fixed configuration, in that, the hats are designed to fit over head of a wearer. Wearers may need to select a suitable size and shape which is convenient for them to wear. The hair length and hair styles of wearers may have a significant role in the selection of a convenient hat.

People having long hair and/or hair tied in different styles (buns, ponytail, deadlocks, etc.) often face inconvenience in finding a suitable hat. In order to accommodate the hair tied in different styles, such people may wear a size which may or may not fit properly. In some cases, such people decide to not wear any hat since the hair tied in different styles cannot be accommodated.

Accordingly, there is an established need for a solution to the problems mentioned above. For instance, there is an established need for a hat which allows users of different hair lengths and hair styles to conveniently wear a hat. Further, there is an established need for a hat that provides a user with the flexibility to extend their hair out of the hat as and when required.

SUMMARY OF THE INVENTION

The present invention relates to a hat configured to be worn by a user. The hat comprises a main portion. The main portion includes an opening at a top side of the main portion. The opening is adapted to be in an exposed state and a covered state. In the exposed state, the opening facilitates the user to extend at least some portion of hair out of the hat. The main portion further includes a support element configured to be in an extended state and a folded state. In the extended state, the support element extends outwardly from the main portion via the opening. The main portion further includes a first VELCRO® (hook and loop fastener) strip and a second VELCRO® (hook and loop fastener) strip configured to be in engagement with each other. When the first VELCRO® (hook and loop fastener) strip is engaged with the second VELCRO® (hook and loop fastener) strip, the opening is in the covered state thereof, and when the first VELCRO® (hook and loop fastener) strip is dis-engaged with the second Velcro VELCRO® (hook and loop fastener) strip, the opening is in the exposed state thereof.

In an aspect, the support element may be made of an elastic nylon material.

In an aspect, when the support element is in the extended state, the support element may be adapted to grip the hair extending out of the hat.

In an aspect, the main portion may comprise a set of inner pockets configured to accommodate the support element when the support element is in the folded state thereof.

In an aspect, the main portion may comprise an elastic band defining the opening.

In an aspect, when the hat is worn by the user, the main portion is to cover a head of the user.

In an aspect, the main portion may comprise a zipper configured to switch between a zipped state and an unzipped state.

In an aspect, when the zipper is in the unzipped state, the main portion may comprise a slot at a back side of the hat, the slot facilitating the user to extend the hair out of the hat from the back side of the hat.

In an aspect, the zipper may comprise a locking latch adapted to facilitate zipping and unzipping of the main portion and/or the support element.

In an aspect, the hat may further comprise a first snap button configured to engage with the locking latch.

In an aspect, the hat may further comprise a second snap button configured to engage with the first snap button.

In an aspect, the hat may comprise a movable flap, wherein the first snap button is disposed on the movable flap, and wherein the second snap button is disposed on the main portion of the hat.

In an aspect, the movable flap may be displaceable to bring the first snap button in engagement with the second snap button.

In an aspect, the main portion may comprise a zipper configured to switch between a zipped state and an unzipped state, wherein when the zipper is in the unzipped state, a slot is exposed in within the main portion, the slot facilitating the user to extend the hair out of the hat from a back side of the hat, and wherein the first snap button and the second snap button when engaged with each other allow partial unzipping of the main portion when the zipper is in the unzipped state.

In an aspect, wherein the slot may be free from a lower end thereof when the first snap button and the second snap button are disengaged, and wherein the slot may be restricted from the lower end thereof when the first snap button and the second snap button are engaged with each other.

In an aspect, the hat may further comprise an extended portion coupled to the main portion.

In an aspect, the main portion may comprise an outer layer of a first material, and an inner layer of a second material that is different from the first material.

In an aspect, a part of the inner layer may extend outwardly from the hat in the form of the support element.

In an aspect, the first VELCRO® (hook and loop fastener) strip may be disposed on an outer surface of the hat, and wherein the second VELCRO® (hook and loop fastener) strip may be disposed on an inner surface of the hat.

In an aspect, the opening at the top side of the main portion of the hat may be defined by an elastic band.

These and other objects, features, and advantages of the present invention will become more readily apparent from the attached drawings and the detailed description of the embodiments and examples, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

Figure 1:
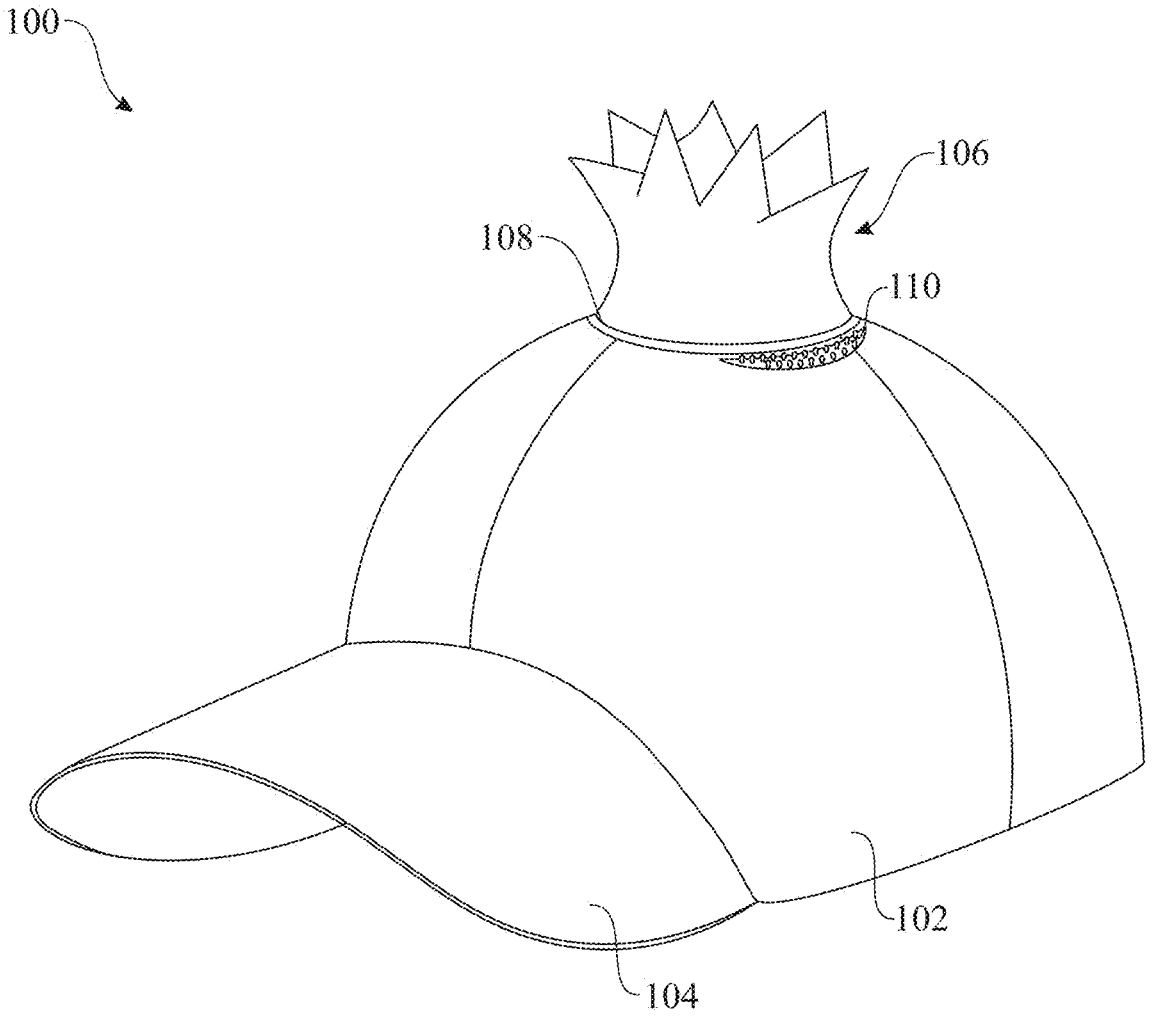
FIG. 1 illustrates an isometric view of a hat having an opening for hair of a user wearing the hat, in accordance with one embodiment of the present specification.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other embodiments. All of the embodiments described below are exemplary embodiments provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in the drawings. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

In the following description, certain specific details are set forth in order to provide a thorough understanding of various disclosed embodiments. However, one skilled in the relevant art will recognize that embodiments may be practiced without one or more of these specific details, or with other methods, components, materials, and the like. In other instances, well-known elements associated with hats have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is, as "including, but not limited to."

As used in this specification and the appended claims, the singular forms "a," "an," and "the" include plural referents unless the content clearly dictates otherwise, and the vice versa. It should also be noted that the term "or" is generally employed in its broadest sense, that is, as meaning "and/or" unless the content clearly dictates otherwise.

The headings and Abstract of the Disclosure provided herein are for convenience only and do not interpret the scope or meaning of the embodiments.

It is appreciated that the terms 'hat' and 'cap' may be used interchangeably in the present disclosure.

Reference is initially made to FIG. 1 which illustrates an isometric view of a hat 100 having an opening for hair of a user wearing the hat, in accordance with an embodiment of the present disclosure. The hat 100 is adapted to be worn by a user having various hair styles and hair lengths. The hat 100 may be worn by a user having short length hair, having long length hair, having hair tied in a ponytail, having hair in dreadlocks, and the like. It is appreciated that although the hat 100 is depicted as a baseball style cap, the details with respect to the hat 100 are equally applicable for other types of hats as well.

The hat 100 may comprise a main portion 102 and an extended portion 104 coupled to the main portion 102. The main portion 102 may be worn over a head of the user so as to cover the head of the user, as would be apparent to a skilled person in view of the disclosure. The main portion 102 may also be known as a crown of the hat in the art. The extended portion 104 may also be known as a brim, a visor, or a flap of the hat in the art. The main portion 102 may be formed of an outer layer of a first material and an inner layer of a second material. In an embodiment, the inner layer may act as a lining of the hat 100. In a non-limiting example, the first material may be wool fabric. In a non-limiting example, the second material may be nylon. It is appreciated that the hat 100 may be without the extended portion 104, e.g., the hat 100 may be a brimless hat, a visorless hat, or a flapless hat.

In an embodiment, the outer layer and the inner layer may be stitched at multiple points so as to form the main portion 102 of the hat 100. In an embodiment, a part of the inner layer may extend outwardly from the hat 100 in the form of a support element 106. The support element 106 may form a part of the inner layer and may be made of the second material. In an embodiment, the support element 106 may be made of an elastic nylon material. The support element 106 may be adapted to be in an extended state and a folded state. In the extended state, the support element 106 may extend outwardly from the hat 100, as is shown in FIG. 1. In the folded state, the support element 106 may be folded inside the hat 100, as well be described in detail further below.

The hat 100 may comprise an elastic band 108 at a top side of the main portion 102. In an embodiment, the elastic band 108 may define an opening (not visible) in the top side of the main portion 102. The opening in the hat 100 may allow the support element 106 to extend outwardly from the main portion 102 of the hat 100, and further, fold within the hat 100 to switch from the extended state to the folded state. The elasticity of the elastic band 108 may facilitate the opening of the hat 100 to be closed and uncovered so as to expose the opening in the hat 100 as well as cover the opening in the hat 100. When the opening is exposed, a user may be enabled to wear the hat 100 such that at least some portion of the hair of the user can be out of the hat 100 through the opening. In an embodiment, the elastic band 108 may be stitched between the inner and outer layers of the hat 100, thereby providing a secure positioning of the elastic band 108.

The hat 100 may further comprise a first VELCRO® (hook and loop fastener) strip 110 disposed on the outer layer of the hat 100. In an embodiment, the first Velcro VELCRO® (hook and loop fastener) strip 110 may form a loop part of a VELCRO® (hook and loop fastener) arrangement. The hat 100 may further comprise a second VELCRO® (hook and loop fastener) strip (not visible in FIG. 1) configured to engage with the first VELCRO® (hook and loop fastener) strip 110. In an embodiment, the second VELCRO® (hook and loop fastener) strip may form a hook part of the VELCRO® (hook and loop fastener) arrangement. The first VELCRO® (hook and loop fastener) strip 110 and the second VELCRO® (hook and loop fastener) strip may facilitate the covering and uncovering of the opening of the hat 100, based on whether a user desires to extend the hair out of the hat 100 through the opening.

Figure 2:
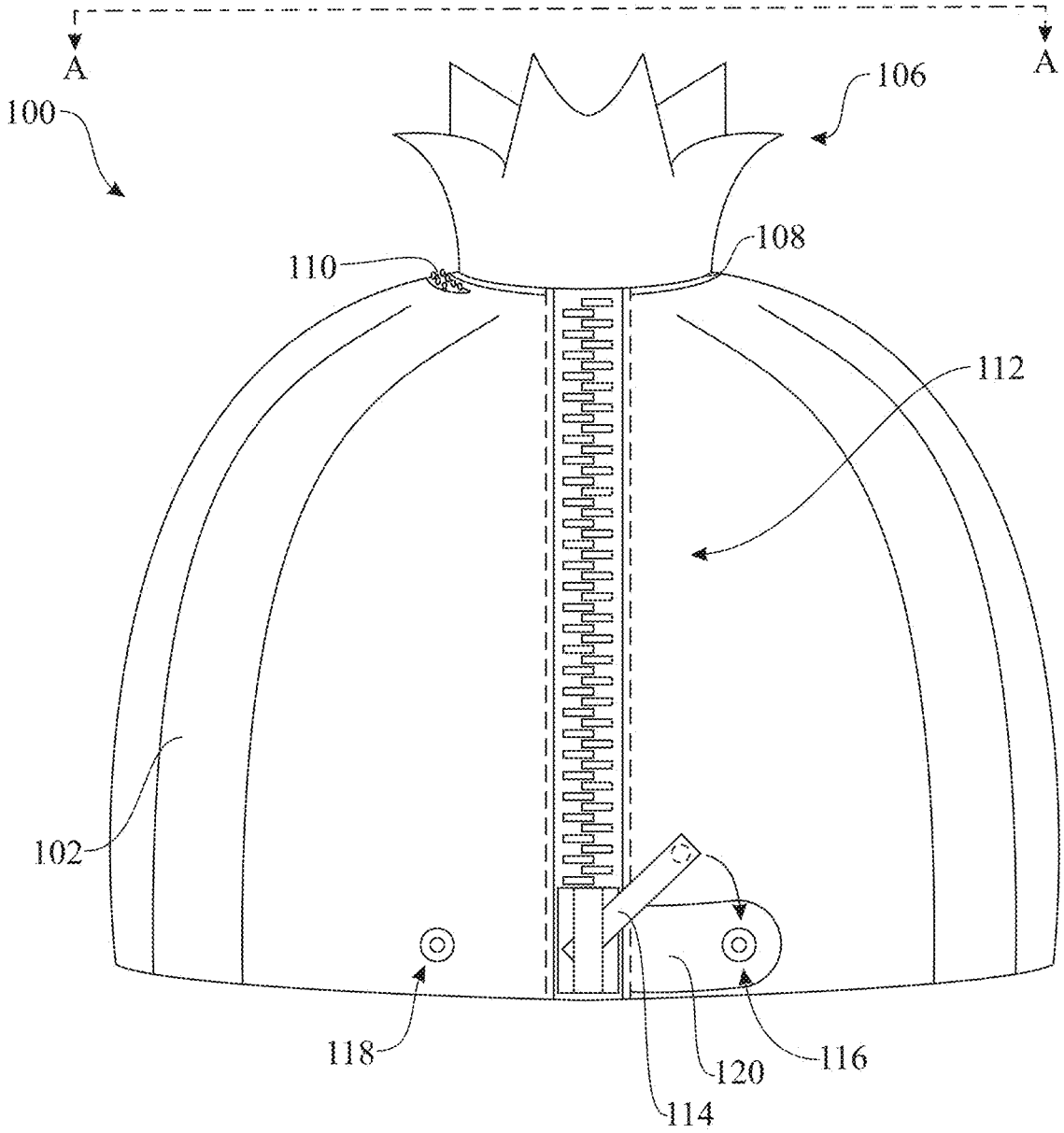
FIG. 2 illustrates the rear view of the hat with a zipper in a zipped state, in accordance with one embodiment of the present specification.
Figure 3:
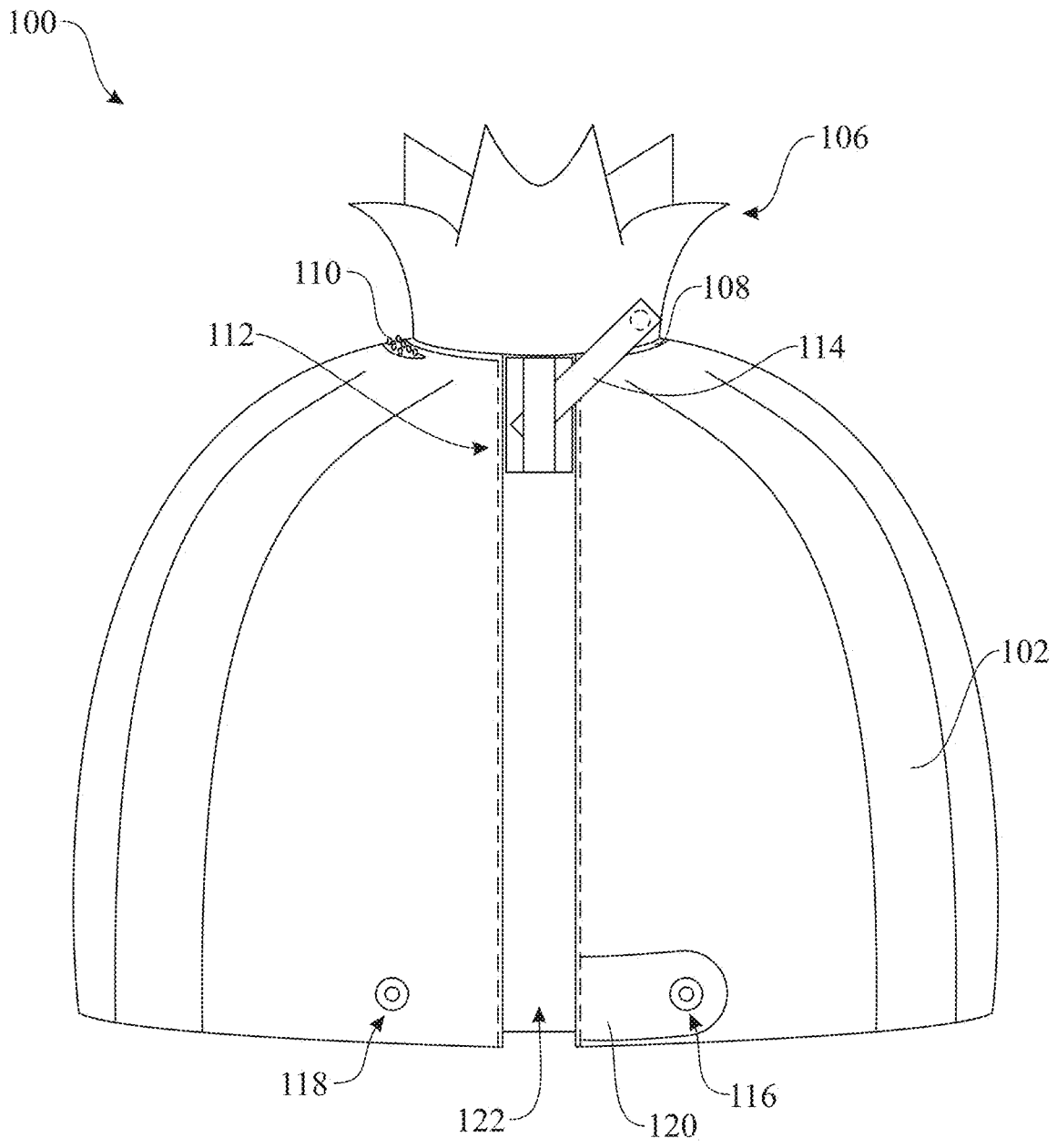
FIG. 3 illustrates the rear view of the hat with a zipper in an unzipped state, in accordance with one embodiment of the present specification.

Referring to FIGS. 2-3, a rear view of the hat 100 of FIG. 1 is depicted, in accordance with an embodiment of the present disclosure. FIG. 2 illustrates the rear view of the hat 100 with a zipper in a zipped state while FIG. 3 illustrates the rear view of the hat 100 with a zipper in an unzipped state.

As shown in FIG. 2, the hat 100 may comprise a zipper 112 disposed on the main portion 102 of the hat 100. The zipper 112 may be configured to zip and unzip the main portion 102. In an embodiment, the zipper 112 may extend to the support element 106 as well so as to zip and unzip the support element 106. In an embodiment, the zipper 112 may be adapted to completely unzip the main portion 102, e.g., separate the main portion 102 into two sub-portions. The zipper 112 may thus be switched between a zipper state as depicted in FIG. 2 and an unzipped state as depicted in FIG. 3. The zipper 112 may comprise a locking latch 114 adapted to facilitate zipping and unzipping of the main portion 102 and/or the support element 106. For instance, the locking latch 114 may be held and pulled by the user to zip and unzip the main portion 102 and/or the support element 106.

The hat 100 may comprise a first snap button 116 configured to engage with the locking latch 114 and securely hold the locking latch 114. In a non-limiting example, the locking latch 114 may be provided with a male member while the first snap button 116 may be provided with a female member such that engagement of the male member with the female member facilitates a secure engagement of the locking latch 114 with the first snap button 116.

The hat 100 may further comprise a second snap button 118 configured to engage with the first snap button 116. In the illustrated embodiment, the first snap button 116 is disposed on a movable flap 120 while the second snap button 118 is disposed on the main portion 102 of the hat 100. The movable flap 120 may be displaced to bring the first snap button 116 in engagement with the second snap button 118, thereby providing a secure coupling. In an embodiment, the first snap button 116 and the second snap button 118 may prevent a complete unzipping of the main portion 102 when the zipper 112 is in the unzipped state thereof.

As seen in FIG. 3, when the zipper 112 is in the unzipped state, a slot 122 is exposed within the main portion 102. The slot 122 may allow a user to keep at least some portion of the hair out of the hat 100 from the back side of the hat 100. The slot 122 may be defined by the extent of unzipping of the zipper 112, in that, slot 122 may be of a variable dimension based on the extent of unzipping of the zipper 112. In an embodiment, the slot 122 may be free from a lower end thereof when the first snap button 116 and the second snap button 118 are not engaged, for instance in the manner as seen in FIG. 3. Further, the slot 122 may be restricted from the lower end thereof when the first snap button 116 and the second snap button 118 are engaged by means of the movable flap 120. Accordingly, the user may extend the hair out of the cap via the slot 122 and/or via the opening defined by the elastic band 108 at the top side of the hat 100.

Figure 4:
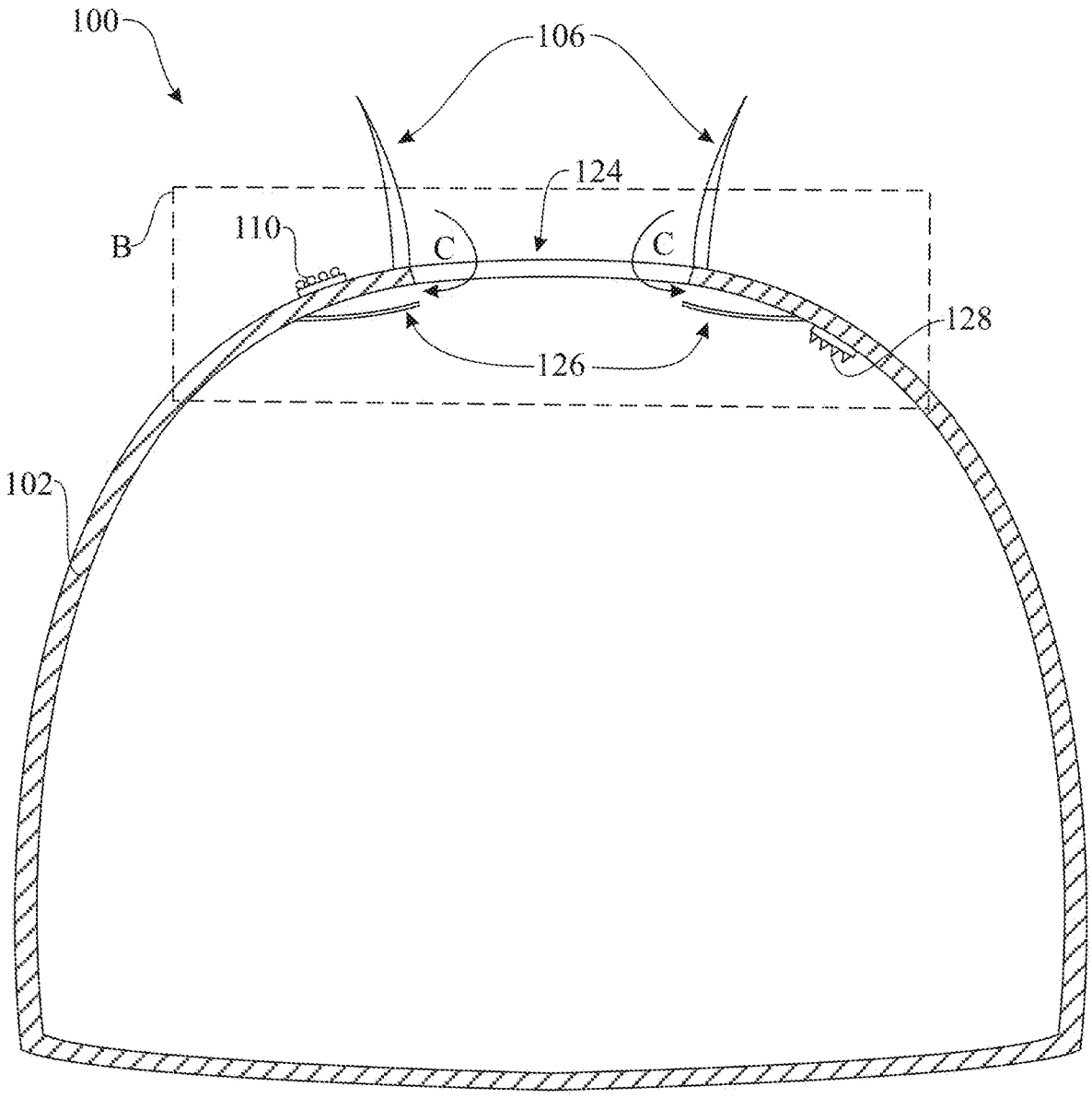
FIG. 4 illustrates a cross-section view of the hat, the cross-section being taken along the line A-A in FIG. 2 in accordance with one embodiment of the present specification.
Figure 5:
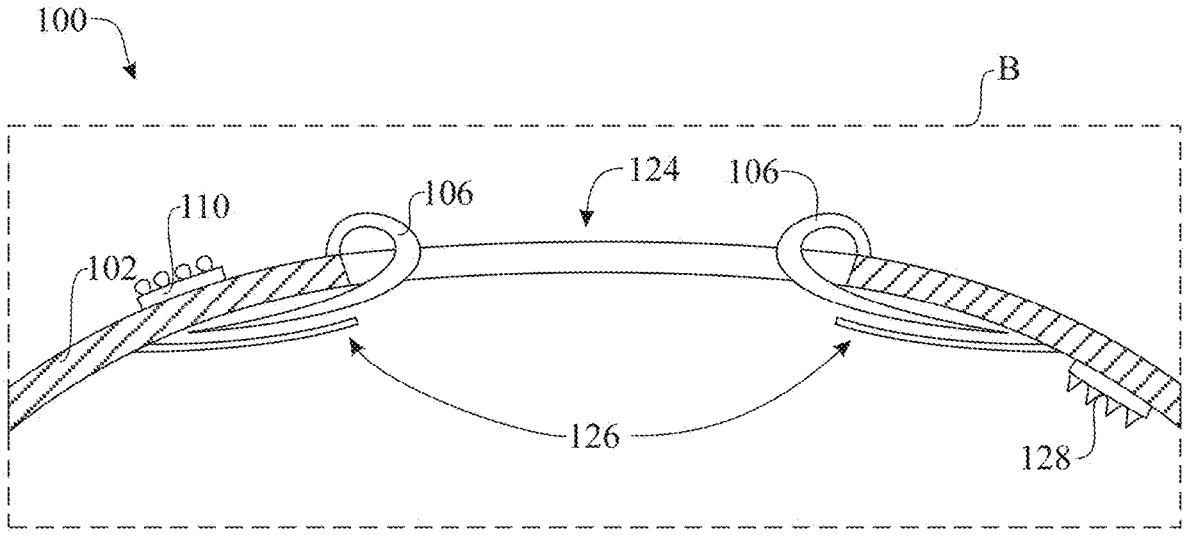
FIG. 5 illustrates a close-up view of the section B in FIG. 4, in accordance with one embodiment of the present specification.

Referring to FIGS. 4 and 5, a cross-sectional view of the hat 100 is depicted, in accordance with an embodiment of the present disclosure. FIG. 4 illustrates a cross-section view of the hat 100, the cross-section being taken along the line A-A in FIG. 2. FIG. 5 illustrates a close-up view of the section B in FIG. 4, with the support element 106 in the folded state.

As seen in FIG. 4, the support element 106 is in the extended state, i.e., extending outwardly from the top side of the hat 100. The opening, labelled as 124, allows the support element 106 to switch between the extended state and the folded state thereof. The opening 124 further enables the user wearing the hat 100 to extend at least some portion of the hair out of the top side of the hat 100 via the opening 124. This is beneficial for users having long hairs as compared to conventional caps that are inconvenient to wear for such users. When the support element 106 is in the extended state, the support element 106 may be adapted to support the hair of the user extending out of the hat 100 by gripping the hair. As is visible in FIGS. 1-4, the support element 106 comprises pointed end portions that facilitate gripping of the hair of the user extending out of the hat 100 from the opening 124.

The hat 100 comprises a set of inner pockets 126 disposed at the inner surface of the hat 100. The set of inner pockets 126 define a space for accommodating the support element 106 there-within. When the support element 106 is to be switched from the extended state to the folded state, the support element 106 may be folded into the set of inner pockets 126, as shown by arrow C. As seen in FIG. 5, the support element 106 is in the folded state, in that, the support element 106 is accommodated within the set of inner pockets 126. In use, the user may fold the support element 106 into the set of inner pockets 126 as and when required.

Figure 6:
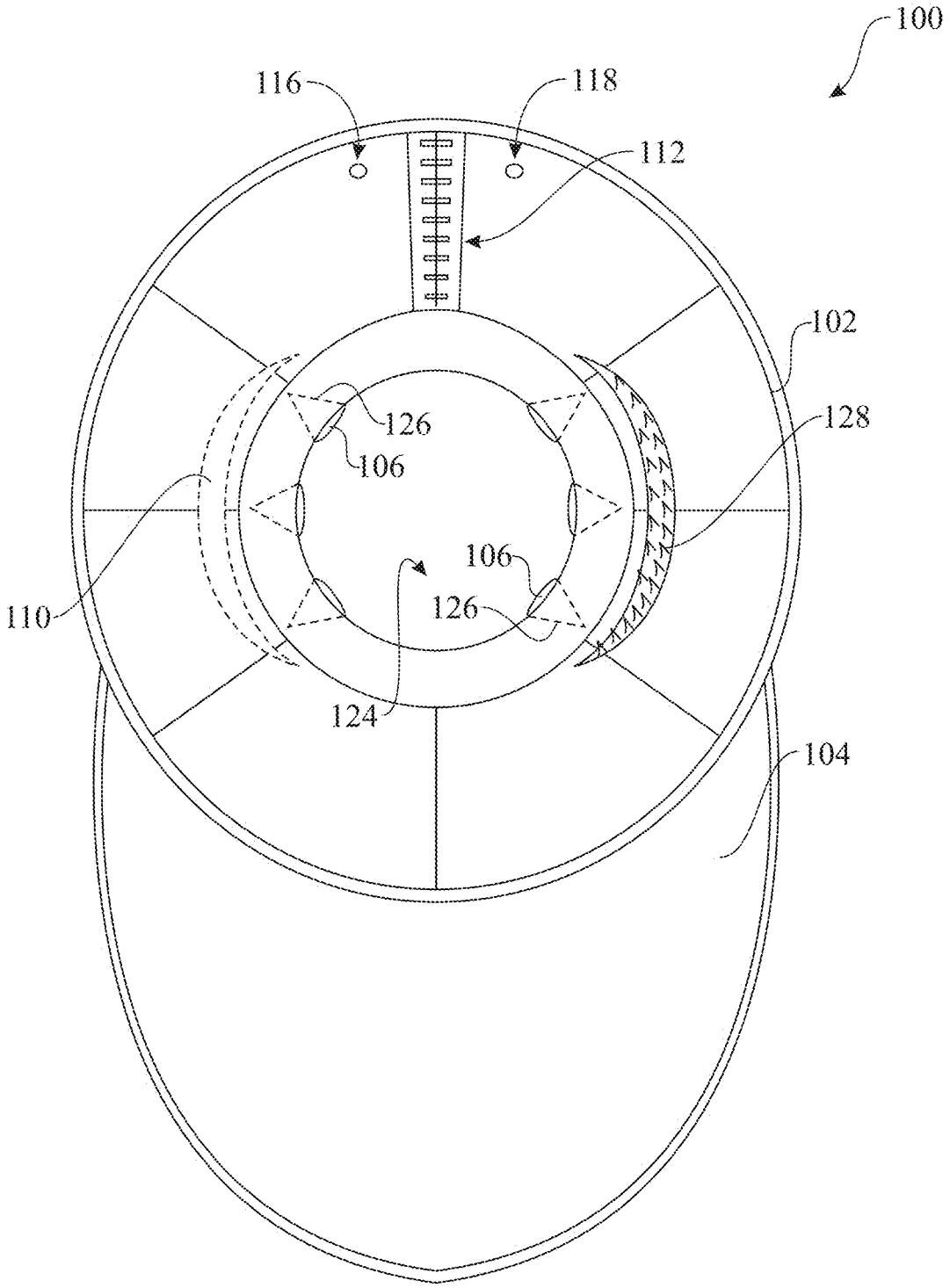
FIG. 6 illustrates a bottom view of the hat, in accordance with one embodiment of the present specification.
Figure 7:
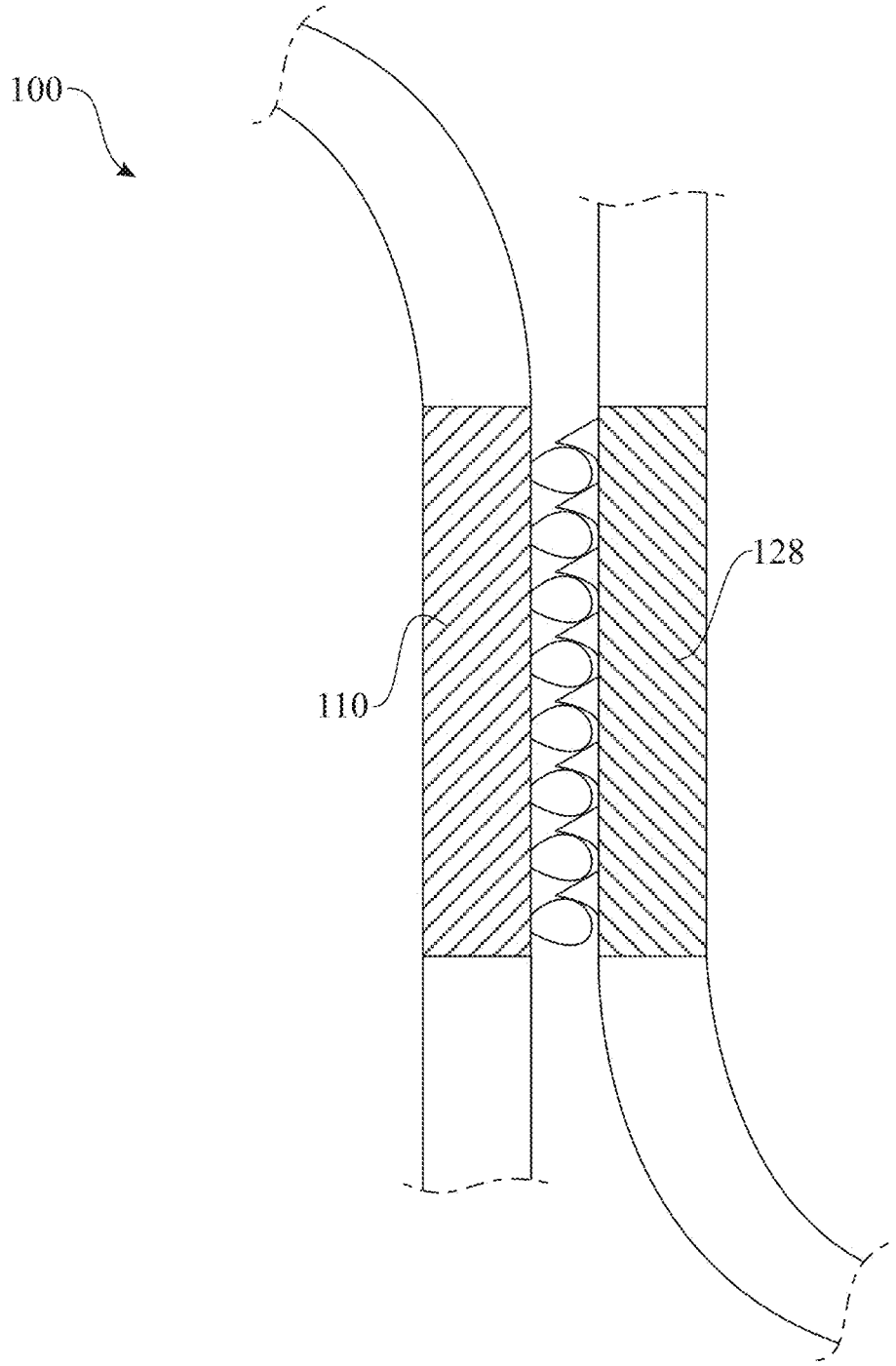
FIG. 7 illustrates a first VELCRO® (hook and loop fastener) strip and a second Velcro VELCRO® (hook and loop fastener) strip of the hat in engagement with each other, in accordance with one embodiment of the present specification.

As described above, the hat 100 comprises the first VELCRO® (hook and loop fastener) strip 110 and the second VELCRO® (hook and loop fastener) strip, labelled as 128. The first VELCRO® (hook and loop fastener) strip 110 and the second VELCRO® (hook and loop fastener) strip 128 are shown in FIGS. 4-5 as well as FIG. 6-7. Reference is now made to FIGS. 6-7 in which FIG. 6 illustrates a bottom view of the hat 100 while FIG. 7 illustrates the first VELCRO® (hook and loop fastener) strip 110 and the second VELCRO® (hook and loop fastener) strip 128 in engagement with each other, in accordance with an embodiment of the present disclosure.

As seen in FIG. 6, the first VELCRO® (hook and loop fastener) strip 110 is disposed on the outer surface of the hat 100 while the second VELCRO® (hook and loop fastener) strip 128 is disposed on the inner surface of the hat 100. The support element 106 is folded within the set of inner pockets 126. In the illustrated embodiment, the opening 124 is exposed, however, the opening 124 may be covered by means of the first and second VELCRO® (hook and loop fastener) strips 110, 128. As described above, the opening 124 is defined by the elastic band 108. By virtue of the elasticity of the elastic band 108, the first VELCRO® (hook and loop fastener) strip 110 and the second VELCRO® (hook and loop fastener) strip 128 may be brought in engagement with each other.

As seen in FIG. 7, the first VELCRO® (hook and loop fastener) strip 110 is in engagement with the second VELCRO® (hook and loop fastener) strip 128. Since the first VELCRO® (hook and loop fastener) strip 110 is disposed at the outer surface of the hat 100 and the second VELCRO® (hook and loop fastener) strip 128 is disposed on the inner surface of the hat 100 at opposite sides, when the first VELCRO® (hook and loop fastener) strip 110 is brought in the second VELCRO® (hook and loop fastener) strip 128, the opening 124 may then be covered. The hat 100 with the covered opening 124 may thus be worn by users having short hair similar to conventional caps. In an embodiment, the first VELCRO® (hook and loop fastener) strip 110 and the second VELCRO® (hook and loop fastener) strip 128 may each be of a predetermined length. In an embodiment, the predetermined length may be about 2 inches.

In an embodiment, the outer material and/or the inner material on the side of the hat 100 having the first VELCRO® (hook and loop fastener) strip 110 may be greater than the outer material and/or inner material on the side of the hat 100 having the second VELCRO® (hook and loop fastener) strip 128. This allows the side of the hat with the first VELCRO® (hook and loop fastener) strip 110 to overlap the opening 124 and facilitate engagement of the first VELCRO® (hook and loop fastener) strip 110 with the second VELCRO® (hook and loop fastener) strip 128. In an embodiment, the dimensions of the elastic band 108 defining the opening 124 may be determined based on user requirements. That is, during manufacturing of the hat 100, the opening 124 may be customized as per the user requirements.

Further, as seen in FIG. 6, the zipper 112 is depicted as being in the unzipped state. With the zipper 112 in the unzipped state, the slot 122 (as shown in FIG. 3) is exposed at the back of the hat 100. This enables the user wearing the hat 100 to extend the hair from the back of the hat 100 via the slot 122. Further, the movable flap 120 (as shown in FIG. 3) may be displaced to bring the first snap button 116 in engagement or out of engagement with the second snap button 118. When the zipper 112 is in the unzipped state and the first snap button 116 is not in engagement with the second snap button, the back of the hat 100 may be free for the user to extend the hair out of the hat 100. In case the user requires a smaller area for the hair to extend out of the hat 100, the user may engage the first snap button 116 with the second snap button 118 while still allowing the hair to be extended via the slot 122 defined by the zipper 112 in the unzipped state.

Further, with the opening 124 at the top side of the hat 100, the user may extend the support element 106 outwardly from the hat 100. As described above, the support element 106 is adapted to support the hair that extends out of the opening 124. The user with long hair tied in a manner requiring the opening 124 at the top side of the hat 100 can conveniently wear the hat 100. Furthermore, when not required, the support element 106 may be folded within the hat 100, i.e., into the set of inner pockets 126. The first VELCRO® (hook and loop fastener) strip 110 may then be brought in engagement with the second VELCRO® (hook and loop fastener) strip 128, thereby covering the opening 124. The hat 100 may thus function as a normal hat.

In use, the users may wear the hat 100 based on the hair length and hair style of the users. For a user having short hair, the user may wear the hat 100 with the zipper 112 in the zipper state, the first snap button 116 in engagement with the second snap button 118, and the opening 124 covered by virtue of the first VELCRO® (hook and loop fastener) strip 110 in engagement with the second VELCRO® (hook and loop fastener) strip 128. For a user having long hair, the user may decide to extend the hair from the top of the hat 100 or from the back of the hat 100. For instance, the user may keep the hair tied in a bun, and to wear the hat 100, the user may expose the opening 124 by dis-engaging the first VELCRO® (hook and loop fastener) strip 110 and the second VELCRO® (hook and loop fastener) strip 128 and then extend the support element 106 in the extended state. Optionally, the user may also unzip the zipper 112. As a result, the user can extend the hair from the top of the hat 100. Moreover, the user may desire to extend the hair from the back of the hat 100, and thus, may unzip the zipper 112 to expose the slot 122. The user can then extend the hair from the back of the hat 100.

A hat having an opening is thus provided which provides a user with multiple options to tie the hair and wear the cap. The hat can be conveniently worn by users having short hair as well as users having long hair. Moreover, the hat provides a user with the flexibility to carry different hair styles while wearing the hat, which is not possible with conventionally available hats.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A hat configured to be worn by a user, the hat comprising:

a main portion comprising an opening at a top side of the main portion, the opening being adapted to be in an exposed state and a covered state, wherein in the exposed state, the opening facilitates the user to extend at least some portion of hair out of the hat;

a support element configured to be in an extended state and a folded state, wherein in the extended state, the support element extends outwardly from the main portion via the opening; and a first hook and loop fastener strip and a second hook and loop fastener strip configured to be in engagement with each other, wherein when the first hook and loop fastener strip is engaged with the second hook and loop fastener strip, the opening is in the covered state thereof, and when the first hook and loop fastener strip is disengaged with the second hook and loop fastener strip, the opening is in the exposed state thereof, wherein the main portion comprises a set of inner pockets configured to accommodate the support element when the support element is in the folded state thereof.

2. The hat of claim 1, wherein the support element is made of an elastic nylon material.

3. The hat of claim 1, wherein when the support element is in the extended state, the support element is adapted to grip the hair extending out of the hat.

4. The hat of claim 1, wherein the main portion comprises an elastic band.

5. The hat of claim 1, wherein when the hat is worn by the user, the main portion is to cover a head of the user.

6. The hat of claim 1, wherein the main portion comprises a zipper configured to switch between a zipped state and an unzipped state.

7. The hat of claim 6, wherein when the zipper is in the unzipped state, the main portion comprises a slot at a back side of the hat, the slot is configured to facilitate the user to extend the hair out of the hat from a back side of the hat.

8. The hat of claim 6, wherein the zipper comprises a locking latch adapted to facilitate zipping and unzipping of the main portion and/or the support element.

9. The hat of claim 8, further comprising a first snap button configured to engage with the locking latch.

10. The hat of claim 9, further comprising a second snap button configured to engage with the first snap button.

11. The hat of claim 10, further comprising a movable flap, wherein the first snap button is disposed on the movable flap, and wherein the second snap button is disposed on the main portion of the hat.

12. The hat of claim 11, wherein the movable flap is displaceable to bring the first snap button in engagement with the second snap button.

13. The hat of claim 10, wherein when the zipper is in the unzipped state, a slot is exposed in within the main portion, the slot is configured to facilitate the user to extend the hair out of the hat from a back side of the hat, and wherein the first snap button and the second snap button when engaged with each other allow partial unzipping of the main portion when the zipper is in the unzipped state.

14. The hat of claim 13, wherein the slot is free from a lower end of the main portion thereof when the first snap button and the second snap button are disengaged from each other, and wherein the slot is restricted from the lower end of the main portion thereof when the first snap button and the second snap button are engaged with each other.

15. The hat of claim 1, further comprising an extended portion coupled to the main portion.

16. The hat of claim 1, wherein the main portion comprises an outer layer of a first material, and the support layer comprises a second material that is different from the first material.

17. The hat of claim 16, wherein a part of the inner layer extends outwardly from the hat in the form of the support element.

18. The hat of claim 1, wherein the first hook and loop fastener strip is disposed on an outer surface of the hat, and wherein the second hook and loop fastener strip is disposed on an inner surface of the hat.

19. The hat of claim 1, wherein the opening at the top side of the main portion of the hat is defined by an elastic band.

* * * * *